US005375829A

United States Patent [19]

Lawlor et al.

[11] Patent Number: 5,375,829

[45] Date of Patent: Dec. 27, 1994

[54] MAGNETIC BALL FLIPPER FOR A ROLLING BALL GAME

[75] Inventors: Patrick Lawlor, Marengo; Lawrence DeMar, Winnetka; Ted Estes, Naperville, all of Ill.

[73] Assignee: Williams Electronics Games, Inc., Chicago, Ill.

[21] Appl. No.: 21,223

[22] Filed: Feb. 23, 1993

[51] Int. Cl.[5] ..... A63F 7/34

[52] U.S. Cl. ..... 273/123 A; 273/129 R; 273/119 A; 273/121 A

[58] Field of Search ..... 273/118 R, 118 A, 118 D, 273/119 R, 119 A, 120 R, 120 A, 121 R, 121 A, 127 R, 129 R, 122 R, 122 A, 123 R, 123 A

[56] References Cited

U.S. PATENT DOCUMENTS 4,373,725 2/1983 Ritchie ..... 273/121 A
4,606,545 8/1986 Ritchie ..... 273/121 A
5,158,291 10/1992 Biagi et al. ..... 273/119 A X

FOREIGN PATENT DOCUMENTS 2127308 4/1984 United Kingdom ..... 273/121 A

*Primary Examiner*—Mark S. Graham
*Assistant Examiner*—Raleigh W. Chiu
*Attorney, Agent, or Firm*—Rockey, Rifkin & Ryther

[57] ABSTRACT

The player controlled play feature consists of an area on or associated with the playfield which is partially confined by a plurality of bumpers. At least one target is provided in this area and an entrance is provided such that a pinball can enter the area defined by the bumpers. Located in the defined area and supported below the surface thereof are a plurality of electromagnets energized by activation of player controlled buttons mounted on the game's cabinet. The game player can selectively activate the electromagnets to redirect the pinball and propel it toward the provided targets.

13 Claims, 4 Drawing Sheets

MAGNETIC BALL FLIPPER FOR A ROLLING BALL GAME

BACKGROUND OF THE INVENTION

The invention relates, generally, to pinball games and, more particularly, to an improved flipper for such games.

Pinball and other rolling ball games typically consist of an inclined playfield supporting a rolling ball and a plurality of playfield features. The game player uses a pair of mechanical flippers mounted at one end of the playfield to direct the ball at various playfield features thereby scoring points and maintaining play.

The success of a manufacturer's line of pinball games depends on its ability to attract players to its games by providing new, interesting and challenging play features and game schemes. Therefore, pinball manufacturers must continually develop new play features.

As previously described, the typical game allows the player to control movement of the pinball through the pair of player operated mechanical flippers. In an effort to increase player appeal some games include additional player controlled flippers located at various positions on the playfield that allow the player additional control. These arrangements, however, merely duplicate the traditional flippers and do not add new player-controlled features to the game. An improved flipper is shown in U.S. Pat. No. 4,380,335 issued to Chaudhry et al. in which the game's microprocessor controls the game flipper automatically. This device, however, still utilizes the well known mechanical flipper mechanism.

Another known feature for altering the movement of a pinball on the playfield consists of an electromagnet mounted below the playfield. The electromagnet is operated by a player controlled button mounted on the game cabinet. The electromagnet was located adjacent the drains (the points on the playfield where the pinball leaves the playfield) such that the player could energize the electromagnet to "grab" the ferromagnetic pinball to prevent it from leaving the playfield. The electromagnet was energized for as long as the player depressed the button such that the electromagnet could hold the ball but was not designed to propel it over the playfield.

Thus, a new player controlled magnetic "flipper" where movement of the ball across the playfield can be controlled by the player is desired.

SUMMARY OF THE INVENTION

The player controlled play feature of the invention consists of an area of the playfield or a separate playfield partially enclosed by a plurality of bumpers. At least one target is provided in this area and an entrance is provided such that a pinball can enter the area defined by the bumpers. Located in the defined area and supported below the surface of the playfield are one or more electromagnets, which can be energized by activation of player controlled buttons mounted on the game's cabinet. The player can selectively apply current to the electromagnets to redirect the pinball motion and propel it toward selected targets. Because the electromagnets are located beneath the playfield, the pinball can move anywhere within the defined area resulting in a very fast paced and exciting play feature. Moreover, the use of the electromagnets allows the player to move the pinball without any mechanism visible on the playfield.

DETAILED DESCRIPTION OF THE INVENTION

Figure 1:
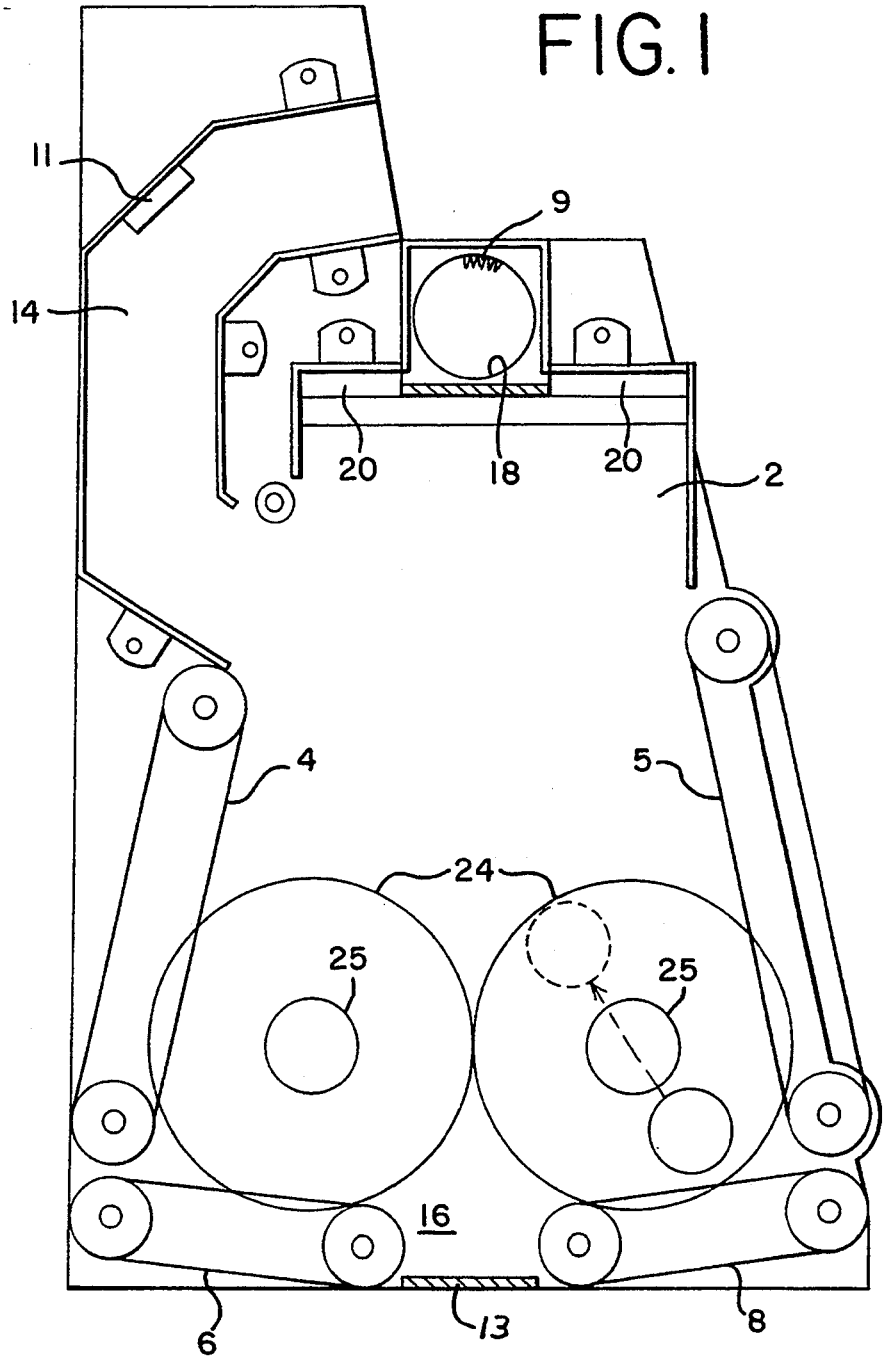
FIG. 1 is a plan view of the play feature of the invention.
Figure 2:
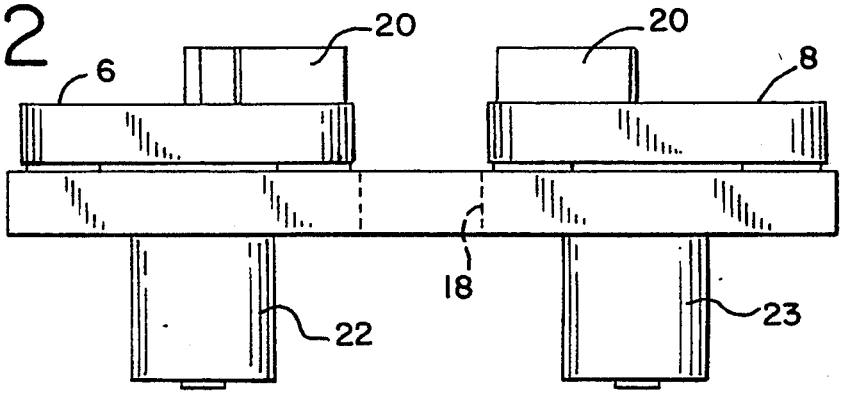
FIG. 2 is a side elevational view showing the play feature of the invention.
Figure 5:
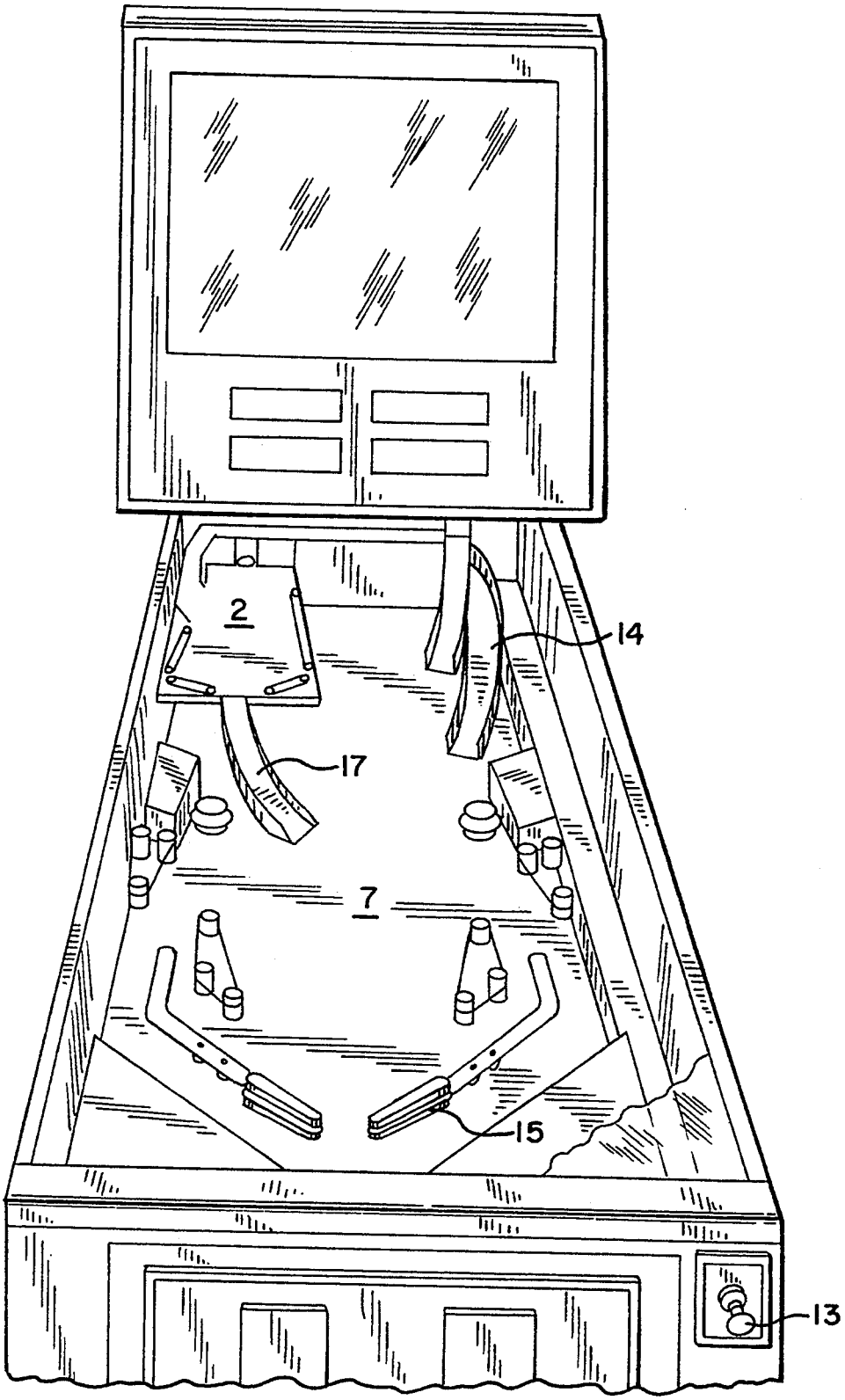
FIG. 5 shows the play feature of the invention mounted on a typical pinball game.

Referring more particularly to FIGS. 1, 2 and 5, the playfield feature of the invention includes a playfield section 2 bounded by rubber rings 4, 5, 6 and 8 on three sides. It will be appreciated that a wide variety of other enclosed configurations are possible. The section 2 may be a part of the main playfield or a separate playfield possibly elevated above the main playfield 7 and accessed by a ramp 14 as shown in FIG. 5.

The illustrated playfield feature is arranged with bumpers 6 and 8 at the front of the usual inclined playfield such that a pinball, absent the application of any other forces, will roll toward bumpers 6 and 8 under the force of gravity. Bumpers 4, 5, 6 and 8 may be provided with switches (not shown) such that when the ball strikes the bumper, signals will be delivered to the game microprocessor to score points or create audio/visual signals as is well known in the art.

Figure 3:
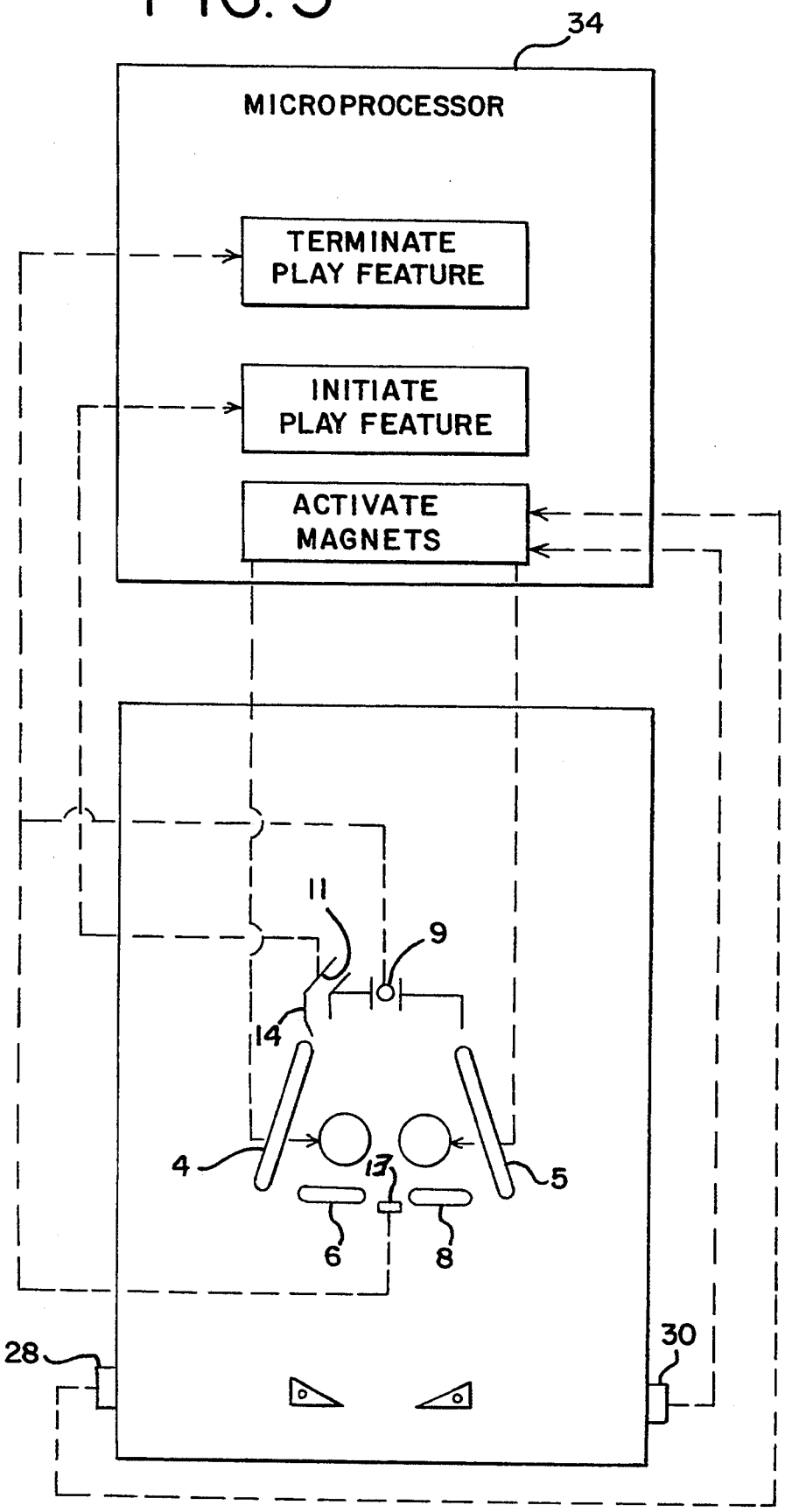
FIG. 3 is a schematic representation of the control system for the play feature of the invention.

The pinball is introduced to the interior of playfield section 2 by ramp 14 or other suitable device. Use of the playfield feature of the invention can be made dependent upon the player achieving a predetermined goal during game play such that the pinball can access ramp 14 only after the goal is attained. For example, a ball diverting gate can be provided in ramp 14 to allow passage of the ball only at predetermined opportunities. A switch 11 is provided on ramp 14 to deliver a signal to the game microprocessor indicating that the pinball has entered section 2 as shown in FIGS. 1 and 3.

As is evident from FIG. 1, bumpers 6 and 8 are spaced from one another such that a gap 16 is created between the bumpers. Gap 16 is dimensioned such that a ball can exit playfield section 2 through this gap and, in the case of the elevated play feature, return to playfield 7 by ramp 17. Switch 13 is provided in gap 16 to deliver a signal to the microprocessor indicating that the ball has exited section 2. Switches 11 and 13 can be of any suitable construction capable of sensing a ball such as optical, mechanical or magnetic switches.

Located at the end of the playfield feature opposite bumpers 6 and 8 are a plurality of targets 20. In a preferred embodiment, optical or stand up targets are used although any suitable target can be used. Disposed centrally of the targets is an out hole 18 through which the ball can pass to exit the playfield section 2 via a ramp, tube or other similar device. A switch is located at out hole 18 to provide a signal to the game microprocessor indicating that the ball has exited section 2 through the out hole.

As best shown in FIG. 2, located beneath playfield section 2 are one or more coils. Preferably two electromagnetic coils 22 and 23 are provided. The number and position of the electromagnets 22 and 23 are visibly indicated to the players by markings on the playfield such as circles 24 and 25 as shown in FIG. 1.

When the microprocessor determines the presence of the pinball in section 2 by the closing of switch 11, player operation of the appropriate flipper buttons 28, 30 will cause the electromagnets 22 and 23 to be energized, as directed by the microprocessor. In the preferred embodiment, the electromagnets are pulsed for not more than 48 milliseconds. The coil or coils are deenergized at time out or when the player releases the flipper button(s), which ever first occurs. Because the pinball is made of a ferromagnetic material, usually steel, the short energization of the electromagnets will propel the ball across playfield section 2. For example, the energization of the electromagnet will attract the ball and cause it to move through the center of the magnet as illustrated by dashed line in FIG. 1. By skillfully operating the electromagnets, the game player can direct the pinball at the targets 20 and prevent its escape from section 2 through gap 16 thereby scoring points.

In the illustrated embodiment it is contemplated that the game will be provided with two player controlled flipper switches 28 and 30, as is typical in existing games, and that each flipper switch will energize one of the electromagnetic coils 22 and 23, respectively. It will be appreciated that the electromagnets can be used to propel a pinball across the playfield in conjunction with other play features arrangements than the one illustrated.

Figure 4:
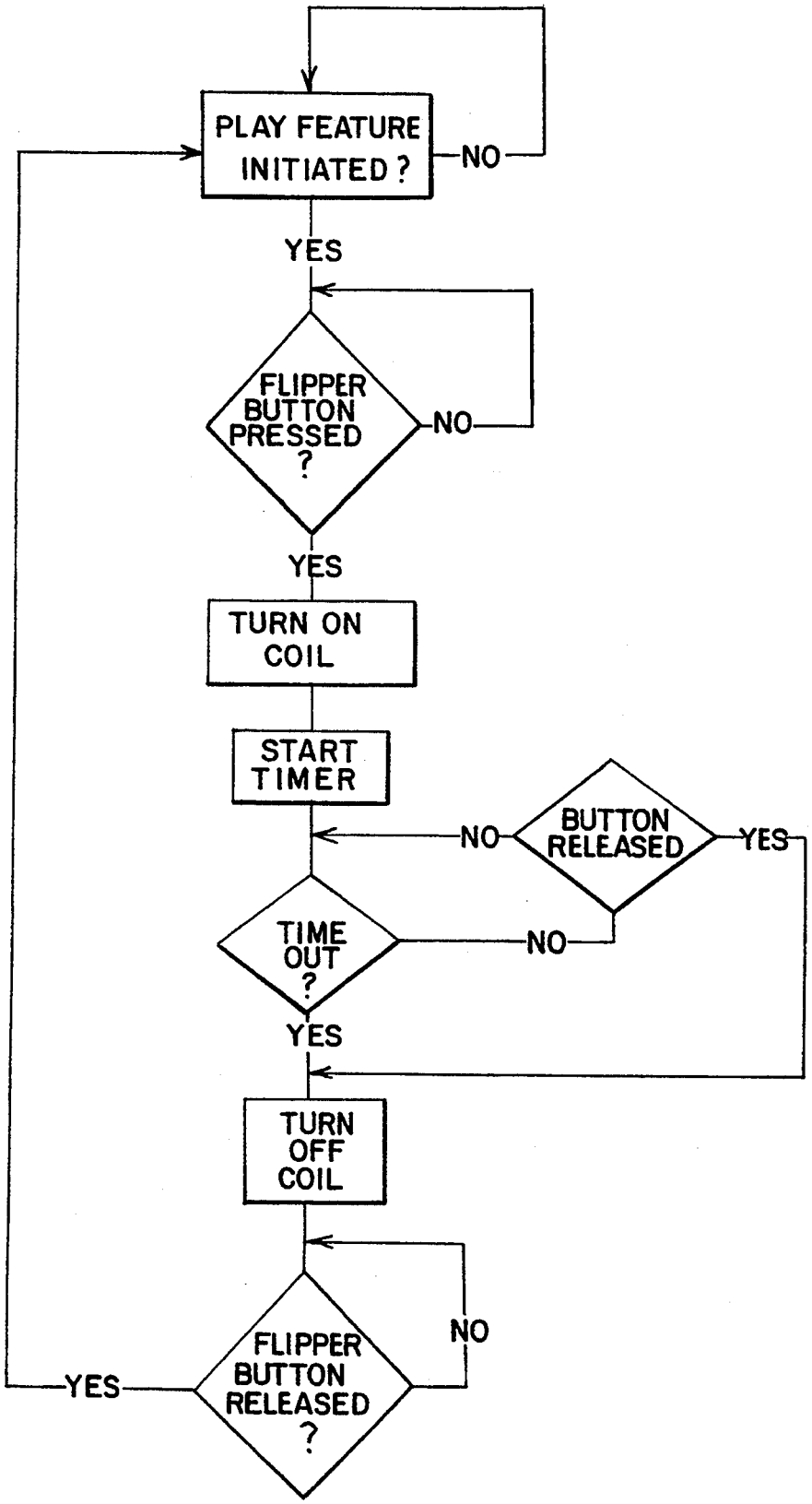
FIG. 4 is a flow chart showing the operation of the play feature of the invention.

Referring to FIGS. 3 and 4, the illustrated embodiment operates as follows. The pinball is prevented from entering ramp 14 by a gate, diverter or the like until the game player achieves a predetermined goal as determined by the rules programmed into the game. Once the goal is achieved the ramp will be accessible to a pinball. When a pinball traverses ramp 14 and enters section 2, switch 11 will be closed and will signal microprocessor 34 that the play feature of the invention should be operable.

Once the microprocessor receives the signal from switch 11, the depression of either one of the player operated flipper switches 28 and 30 will cause the energization of the appropriate electromagnet (rather than or in addition to the mechanical flippers which may normally be controlled by the flipper buttons). The microprocessor will turn off the coil when the desired time, i.e. 48 milliseconds, has elapsed. The player is then required to release the flipper button before the coil can be reactivated to prevent the player from maintaining the coil "on" continuously. Play of the play feature will continue until the ball exits section 2 through gap 16 as detected by switch 13 or exits through out hole 15 as detected by switch 9.

While the invention has been described in some detail with respect to the drawings, it will be appreciated that numerous changes in the details and construction of the device can be made without departing from the spirit and scope of the invention. For example, the electromagnets do not have to be arranged in the illustrated configuration nor do they have to be confined to any particular playfield section.

What is claimed is:

1. A pinball game comprising:

a) an inclined playfield;

b) a ferromagnetic ball supported on the playfield;

c) a portion of the playfield being at least partially enclosed by bumper means;

d) at least one target located in said enclosed portion of the playfield to be contacted by said ball;

e) means for allowing the ball to enter the enclosed portion;

f) means for allowing the ball to exit the enclosed portion;

g) at least one electromagnetic means in operative relation to the enclosed section for propelling the ball over the playfield solely by means of the magnetic field created when the electromagnet is energized, said at least one electromagnetic means being located adjacent said means for allowing the ball to exit such that energization of the electromagnetic means can prevent the ball from exiting the enclosed portion; and h) player controlled means for briefly energizing said at least one electromagnetic means to propel the ball over the enclosed portion whereby points are scored when the ball contacts said at least one target.

2. In combination: a play feature for directing and propelling a ferromagnetic ball at a target and; an inclined playfield on which a ferromagnetic ball can roll, the combination comprising:

a) a ferromagnetic ball;

b) an inclined playfield a section of the playfield being at least partially enclosed by bumper means;

c) targets in said section for being contacted by said ball;

d) at least one electromagnetic means in operative relation to the section for propelling the ball solely by means of the magnetic field created when the electromagnetic is energized; and e) player controlled means for briefly energizing said at least one electromagnet means to propel the ball over the section whereby points are scored by contacting said targets.

3. The play feature of claim 2, wherein said section is elevated relative to said playfield.

4. The play feature of claim 2, further including a ramp for delivering the ball to the section.

5. The play feature of claim 2, further including means for allowing the pinball to exit said section.

6. A play feature for directing and propelling a ferromagnetic ball at a target on a playfield of an amusement game comprising:

a) a ferromagnetic ball;

b) an electromagnet to be disposed in operative relation to said playfield for propelling the ball solely by means of the magnetic field created when said electromagnet is energized;

c) a target means for producing a signal when contacted by said ball; and d) player controlled means for briefly energizing said electromagnet when said ball is at a desired position relative to said electromagnet to control the direction of the force applied to propel the ball at said target means.

7. The play feature according to claim 6 wherein said target means and said electromagnet are adapted to be located in a partially enclosed area associated with said playfields whereby points are scored by successfully directing the ball at said target means using said electromagnet.

8. The play feature according to claim 6, wherein said electromagnet is adapted to be located in a partially enclosed area associated with said playfield and wherein points are scored by successfully maintaining the ball within said partially enclosed area using said electromagnet.

9. The play feature according to claim 6, wherein the electromagnet is adapted to be located beneath a section of the playfield defined by a plurality of bumpers.

10. The play feature according to claim 9, further including a means for delivering a signal indicating that a ball has entered said section of playfield.

11. The play feature according to claim 9, further including means for delivering a signal indicating that the ball has exited said section of playfield.

12. The play feature according to claim 9, further including targets located in said section of playfield.

13. A method for directing and propelling a ferromagnetic ball at a target on a playfield of an amusement game comprising the steps of:

a) disposing an electromagnet in operative relation to said playfield for propelling the ball solely by means of the magnetic field created when said electromagnet is energized;

b) briefly energizing said electromagnet when said ball is at a desired position relative to said electromagnet to control the direction of the force applied to propel the ball at said target.

* * * * *